US006220284B1

(12) United States Patent
Hayashi et al.

(10) Patent No.: US 6,220,284 B1
(45) Date of Patent: Apr. 24, 2001

(54) PILOT OPERATED DIRECTIONAL CONTROL VALVE HAVING POSITION DETECTING FUNCTION

(75) Inventors: Bunya Hayashi; Makoto Ishikawa, both of Tsukuba-gun (JP)

(73) Assignee: SMC Corporation, Tokyo (JP)

( * ) Notice: Subject to any disclaimer, the term of this patent is extended or adjusted under 35 U.S.C. 154(b) by 0 days.

(21) Appl. No.: 09/593,490

(22) Filed: Jun. 14, 2000

(51) Int. Cl.[7] ..... F15B 13/043

(52) U.S. Cl. ..... 137/554; 137/884; 137/625.64; 137/625.65

(58) Field of Search ..... 137/625.64, 554, 137/884, 625.65

(56) References Cited

U.S. PATENT DOCUMENTS

| | | | | |
|---|---|---|---|---|
| 3,598,360 | | 8/1971 | Merriner et al. . | |
| 4,409,580 | | 10/1983 | Ishigaki . | |
| 5,244,002 | * | 9/1993 | Frederick | 137/1 |
| 5,326,070 | | 7/1994 | Baron . | |
| 5,623,967 | * | 4/1997 | Hayashi | 137/625.64 |
| 5,687,698 | | 11/1997 | Mastro et al. . | |
| 5,829,481 | * | 11/1998 | Tajima et al. | 137/884 |

FOREIGN PATENT DOCUMENTS 1 279 509 6/1972 (GB) .

* cited by examiner

*Primary Examiner*—A. Michael Chambers
(74) *Attorney, Agent, or Firm*—Oblon, Spivak, McClelland, Maier & Neustadt, P.C.

(57) ABSTRACT

The present invention aims to provide a pilot operated directional control valve having a position detecting function, capable of detecting operating positions of a valve member via the piston for driving the valve member. To achieve this, a magnet 21 for position detecting is installed on the portion which is situated on a piston 12*a* abutted against one end of a spool 6, and which is adjacent to a breathing chamber 9 shut off from a pilot pressure chamber 13*a*, and a magnetic sensor 21 for detecting the magnetism from the magnet 21 is mounted on the portion opposite to the magnet 21, in the casing 4.

6 Claims, 4 Drawing Sheets

PILOT OPERATED DIRECTIONAL CONTROL VALVE HAVING POSITION DETECTING FUNCTION

TECHNICAL FIELD

The present invention relates to a pilot operated directional control valve having a position detecting function, improved by permitting the detection of operating positions of a valve member such as a spool, through the use of a magnet.

BACKGROUND ART

The directional control valve capable of monitoring the changeover operation of a spool utilizing a magnet is well known as disclosed in, for example, Japanese Examined Utility Model Publication No. 7-31021(Japanese Unexamined Utility Model Publication No. 2-88079). This directional control valve is provided on both ends of a spool with respective pistons for receiving pilot fluid pressure, and is adapted to change over the spool by the fluid pressure acting on the pistons. This directional control valve has a magnet mounted on one piston, and has a detection coil for detecting the change in magnetic flux, installed at a position opposite to the magnet mounted on a casing, whereby the directional control valve detects the moving speed of the piston, or the spool from the magnitude of the induced voltage generated in the detection coil by the change in magnetic flux when the magnet moves together with the piston, and judges whether the moving speed is normal or not.

However, since the above-described conventional directional control valve is constituted so that the magnet is installed at a position which is exposed to the pressure chamber adjacent to an end face of the piston, the magnet will directly contact a pilot fluid. Therefore, when the fluid contains water, chemical mist, particulates of magnetic material such as metallic powder, or the like, there has often arisen the problem that the contact of the magnet with these substances makes the magnet rust, corrode, or adsorb the particulates. This would bring about drawbacks of reducing the detecting accuracy due to the decrease in magnetic force, or incurring poor sliding conditions.

Furthermore, the above-described valve is constituted so as to make the detection coil generate an induced voltage in response to the change in magnetic flux with the movement of the magnet, and to detect the moving speed of the spool from the magnitude of the induced voltage to judge whether the moving speed is normal or not, but can not detect operating positions of the spool.

DISCLOSURE OF INVENTION

The main technical problem of the present invention is to provide a pilot operated directional control valve having a position detecting function, capable of detecting operating positions of a valve member via the piston for driving the valve member.

The other technical problem of the present invention is to prevent the magnet from contacting the pilot fluid and being affected by the pilot fluid, and thus to maintain a stable detecting accuracy and operating characteristics.

In order to solve the above-described problems, in accordance with the directional control valve of the present invention, a magnet for position detecting is mounted on the piston provided on one end of a valve member, and a magnetic sensor for detecting the magnetism from the magnet is installed at a portion opposite to the magnet, in the casing. The position where the magnet is installed on the piston is a portion, on one end side of the piston, adjacent to a breathing chamber defined by the piston and an end face of the valve member. This breathing chamber is hermetically shut off from the pilot pressure chamber disposed on the opposite side of the breathing chamber, in the piston, by the piston packing on the outer periphery of the piston so as to prevent the pilot fluid from flowing into the breathing chamber.

In the directional control valve having the above-described features, the piston is driven by the pilot fluid supplied into the pilot pressure chambers, and the valve member is changed over via the piston. A magnetic flux density from the magnet moving together with the piston is detected by the magnetic sensor, and operating positions of the piston, or those of the valve member are detected by the change in magnetic flux density with the movement of the magnet.

Herein, since the magnet is installed at a position adjacent to the breathing chamber of the piston, the magnet is prevented from directly contacting the pilot fluid. Therefore, even if the pilot fluid contains water, chemical mist, particles of magnetic material such as metallic particles, or the like, there is no risk of the magnet rusting, corroding, or adsorbing particulates. This prevents the decreasing in magnetic force, and the occurring of a malfunction due to adsorbed particulates, permitting the maintaining of a stable performance.

In accordance with a specific embodiment of the present invention, the magnet is provided on the outer periphery of the piston, and the magnetic sensor is provided at a portion in the casing, adjacent to the outer periphery of the piston.

In accordance with another specific embodiment of the present invention, a housing is formed in the surface opposite to the valve member, in the piston, the magnet is installed in the housing so as to be situated adjacent to the pressure receiving surface of the piston, and the magnetic sensor is provided at a position opposite to the pressure receiving surface, in the casing.

In accordance with still another specific embodiment of the present invention, there is provided a double-pilot type directional control valve having two pistons and two pilot valves, wherein two pilot valves are concentratedly provided on one end side of a casing, and wherein, on the other side of the casing, a magnet and a magnetic sensor are provided on one piston and on the casing, respectively.

In the present invention, the piston having at least a magnet may be coupled to the valve member.

In the present invention, it is preferable that the magnetic sensor is installed so as to be able to detect the magnetism from the magnet over the whole stroke of the piston, and that it is therefore constituted so as to detect all operating positions of the piston from the change in magnetic flux density with the displacement of the magnet.

Thereby, not only the stroke end positions of the piston, or the valve member, but also positions on the way of the stroke can be known. It is therefore possible to easily discriminate, by a discrimination circuit, whether the valve member has normally operated or not, from the relations between the position and the operating time of the valve member from the initiation to the termination of a stroke thereof. This permits taking precautionary measures before a failure happens, and preventing a long downtime of working system due to a failure or an accident.

DETAILED DESCRIPTION OF THE INVENTION

Figure 1:
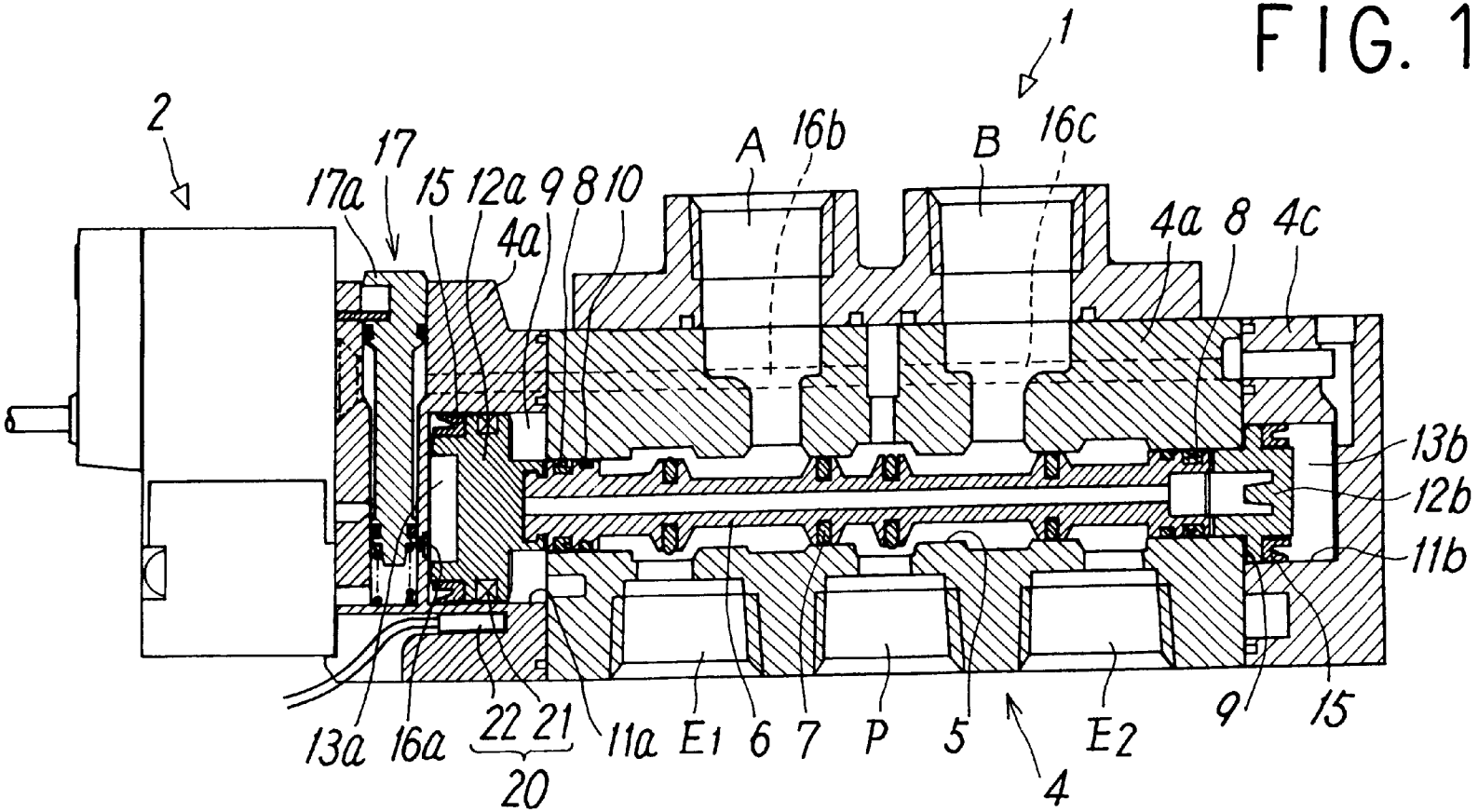
FIG. 1 is a longitudinal sectional view of a first embodiment of the directional control valve in accordance with the present invention.

FIG. 1 shows the first embodiment of the directional control valve in accordance with the present invention. The directional control valve here exemplified is a single-pilot type directional control valve wherein a main valve 1 is changed over by one pilot valve 2.

The main valve 1 has a construction as a 5-port valve, and includes a casing 4 constructed of non-magnetic material. The casing 4 comprises a first member 4*a* of cuboid shape, a second member 4*b* which is connected to one end of the first member 4*a* and which also serves as an adapter for mounting the pilot valve 2, and a third member 4*c* which is connected to the other end of the first member 4*a* and which functions as an end cover.

A supply port P and two discharge ports E1 and E2 are provided on either of the upper and lower surfaces of the first member 4*a*, and two output ports A and B are provided on the other surface. Inside the first member 4*a*, there is provided a valve hole 5 to which these ports are each opened being arranged in the axial direction. In the valve hole 5, there is slidably received a spool 6 which is a valve member for changing over flow passages and which is constructed of non-magnetic material.

On the outer periphery of the spool 6, there are provided a plurality of sealing members 7 for mutually defining flow passages connecting the above-mentioned ports, and on the outer peripheries of both end portions of the spool 6, there are provided respective end sealing members 8 for shutting off the breathing chambers 9 facing the ends of the spool 6, from the passages of the hydraulic fluid in the valve hole 5. Reference numeral 10 in FIG. 1 denotes a guide ring for stabilizing the sliding of the spool 6.

On the other hand, in the second member 4*b* and the third member 4*c*, the piston chamber 11*a* and 11*b* are formed, respectively, at positions facing both ends of the spool 6. A first piston chamber 11*a* formed in the second member 4*b* has a large diameter, and a first piston 12*a* of large diameter is slidably received in the piston chamber 11*a*, while a second piston chamber 11*b* formed in the third member 4*c* has a smaller diameter than the first piston chamber 11*a*, and a second piston 12*b* of small diameter is slidably received in the piston chamber 11*b*. Each of these pistons 12*a* and 12*b* is adapted to move in synchronization with the spool 6 by being abutted against the end face of the spool 6 as representatively shown by the second piston 12*b*, or by being unitarily coupled to the spool 6 as representatively shown by the first piston 12*a*. In the example shown in FIG. 2, in order to connect the piston to the spool 6, a hook 14*a* provided for the piston 12*a* is engaged with a locking groove 14*b* on the outer periphery of the spool 6, but the method for coupling the piston 12*a* to the spool 6 is not particularly limited.

First and second pressure chambers 13*a* and 13*b* are formed on the back sides of the pistons 12*a* and 12*b*, that is, on the opposite sides of the piston surfaces abutting against the spool 6, respectively. Between the pistons 12*a* and 12*b*, and the spool 16, there are formed the breathing chambers 9 and 9 which are opened to the outside, respectively. The pressure chambers 13*a* and 13*b* are hermetically shut off from the breathing chambers 9 and 9 by piston packing 15 and 15 mounted on the outer peripheries of the piston 12*a* and 12*b*, respectively.

The first pressure chamber 13*a* situated adjacent to the first piston 12*a* of large diameter communicates with the supply port P through the pilot fluid passages 16*a* and 16*b* via a manual operating mechanism 17 and the abovementioned pilot valve 2, while the second pressure chamber 13*b* situated adjacent to the second piston 12*b* of small diameter always communicates with the supply port P through the pilot fluid passage 16*c*.

When the pilot valve 2 is in the"off" state, that is, when the first pressure chamber 13*a* is not supplied with a pilot fluid, the second piston 12*b* is pushed by the pilot fluid pressure supplied to the second pressure chamber 13*b*, so that the spool 6 is situated at the first changeover position moved to the left side, as shown in FIG. 1. Once the pilot valve 2 is turned "on",that is, the first pressure chamber 13*a* is supplied with the pilot fluid, the spool 6 is pushed by the first piston 12*a*, so that the spool 6 moves to the right side and occupies the second changeover position. This is because the acting force of fluid pressure acting on the first piston 12*a* is larger than that acting on the second piston 12*b* due to the difference in the pressure receiving area between the two piston 12*a* and 12*b*.

The above-mentioned manual operating mechanism 17 is adapted to directly connect the pilot fluid passages 16*a* and 16*b* by depressing an operating element 17*a*, and to thereby make the first pressure chamber 13*a* communicate with the supply port P. This operating state is the same as that in which the pilot valve 2 is"on".

Here, the above-mentioned pilot valve 2 is an electromagnetically operated solenoid valve for opening/closing pilot fluid passages by energizing a solenoid. Since its constitution and operation are the same as the known one, a specific explanation thereof is omitted.

Figure 2:
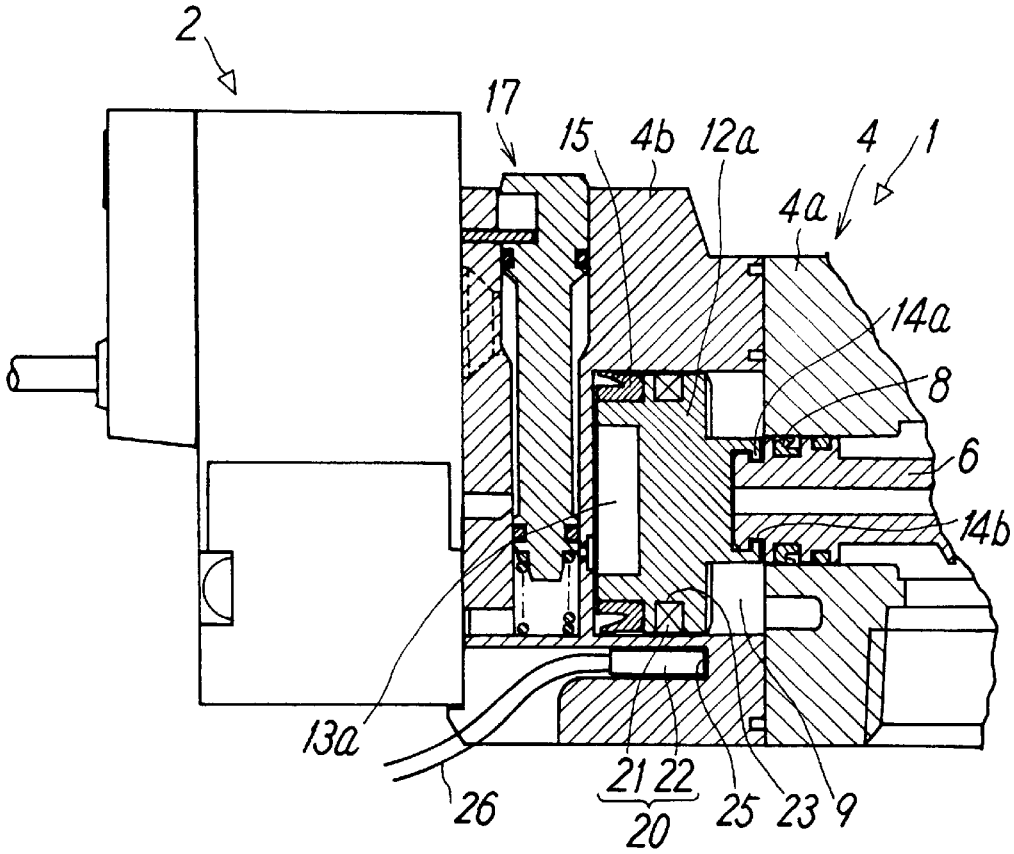
FIG. 2 is an enlarged view showing the main section of FIG. 1.

The above-described directional control valve is provided with a position detecting mechanism 20 for detecting the operating positions of the spool 6. As shown in FIG. 2, the position detecting mechanism 20 comprises a magnet 21 mounted on any one of the pistons (in FIG. 2, the first piston 12*a* is exemplified), and a magnetic sensor 22 which is installed at a position adjacent to the casing 4 and which detects the magnetism from the magnet 21. The position detecting mechanism 20 is adapted to detect, by means of the magnetic sensor 22, the change in magnetic flux density when the magnet 21 moves together with the piston 12*a*, and detects operating positions of the piston 12*a*, or the spool 6, from the changes in magnetic flux density.

The magnet 21 is produced by mixing metallic powder having magnetic property into soft elastic base material such as synthetic resin or synthetic rubber and forming the obtained mixture into annular body having a notch at a part of circumference thereof. The magnet 21 is installed at a position on the outer periphery of the piston 12*a*, adjacent to the breathing chamber 9 and more interior than the piston packing 15. More specifically, the magnet 21 is installed at the above-mentioned position by fitting the annular magnet 21 into a mounting groove 23 formed on the outer periphery of the piston 12*a* in a state where the diameter thereof is elastically expanded.

In this case, it is preferable to make the thickness of the magnet 21 slightly less than the depth of the mounting groove so that the outer peripheral surface of the magnet 21 becomes lower than that of the piston 12*a* in order to prevent the outer peripheral surface of the magnet 21 from rubbing against the inner peripheral surface of the piston chamber 11*b*. This permits not only the prevention of the increase in sliding resistance of the piston 12*a* due to the rubbing of the magnet 21 against the inner peripheral surface of the piston chamber, but also the prevention of suffering an adverse effect on the sliding of the piston 12*a* even if the magnet 21 adsorbs some magnetic particulates in the atmosphere.

Thus, by disposing the magnet 21 at a position adjacent to the breathing chamber 9, on the outer periphery of the piston 12*a*, the magnet 21 can be prevented from directly contacting the pilot fluid. As a consequence, even if the pilot fluid contains water, chemical mist, magnetic particles such as metallic powder, or the like, there is no risk of the magnet rusting, corroding, or adsorbing magnetic particulates due to the contact of the magnet 21 with these substances. This prevents the reduction in position detecting accuracy due to the decrease in magnetic force, or the occurrence of a malfunction of the piston 12*a* due to adsorbed particulates.

On the other hand, the magnetic sensor 22 is installed at a position adjacent to the magnet 21, in the housing 25 formed in the second member 4*b* of the casing 4, so as to be able to detect the magnetism from the magnet 21 over the whole stroke of the spool 6. More specifically, the magnetic sensor 22 is disposed at a position such that, when the spools 6 is situated at any one of the stroke ends, the magnetic sensor 22 is the closest to the magnet 21 and detects the highest magnetic flux density, and that, when the spool 6 is situated at the other stroke end, the magnetic sensor 22 is away from the magnet 21 and detects the lowest magnetic flux density.

The magnetic sensor 22 is constituted so as to be connected to a discriminating circuit (not shown) through a lead wire 26, and to output a detection signal corresponding to a magnetic flux density to this discriminating circuit. In the discriminating circuit, data necessary for position detection such as the interrelations of the operating position with the magnetic flux density, operating time, and fluid pressure when the piston 12*a* (consequently the spool 6) normally operates, have been inputted in advance. Once a detection signal from the magnetic sensor 22 is inputted, the discriminating circuit measures the positions at both stroke ends of the piston 12*a* and each position during a stroke based on the above-mentioned data, and can discriminate whether the changeover operation of the piston 12*a* and consequently that of the spool 6 has been normal or not, from the relations between the operating time and the position of the piston 12*a* from the initiation to the termination of a stroke thereof. Thereby, it is possible to detect a sign of failure and to take precautionary measures against a failure in advance, and thereby to avoid an situation such that the operation of device stops for a long time due to the occurrence of a failure or an accident.

Herein, the operating positions, operating times, etc. for the piston 12*a* which have been detected, can be displayed on a display device in the form of numeral values or graphs.

In the above-described embodiment, a single magnetic sensor 22 is provided, but two magnetic sensors may be provided on both stroke ends of the piston 12*a* so as to be each situated at positions opposite to the magnet 21. In this case, operating positions of the spool 6 can be known from the change in magnetic flux density which has been detected through the two magnetic sensors, by setting the positional relations between the two magnetic sensors and the magnet as follows. When the piston 12*a* is situated at one stroke end, one magnetic sensor detects the highest magnetic flux density while the other magnetic sensor detects the lowest magnetic flux density. On the other hand, when the piston 12*a* is situated at the other stroke end, the situation becomes reverse of the former case.

Figure 3:
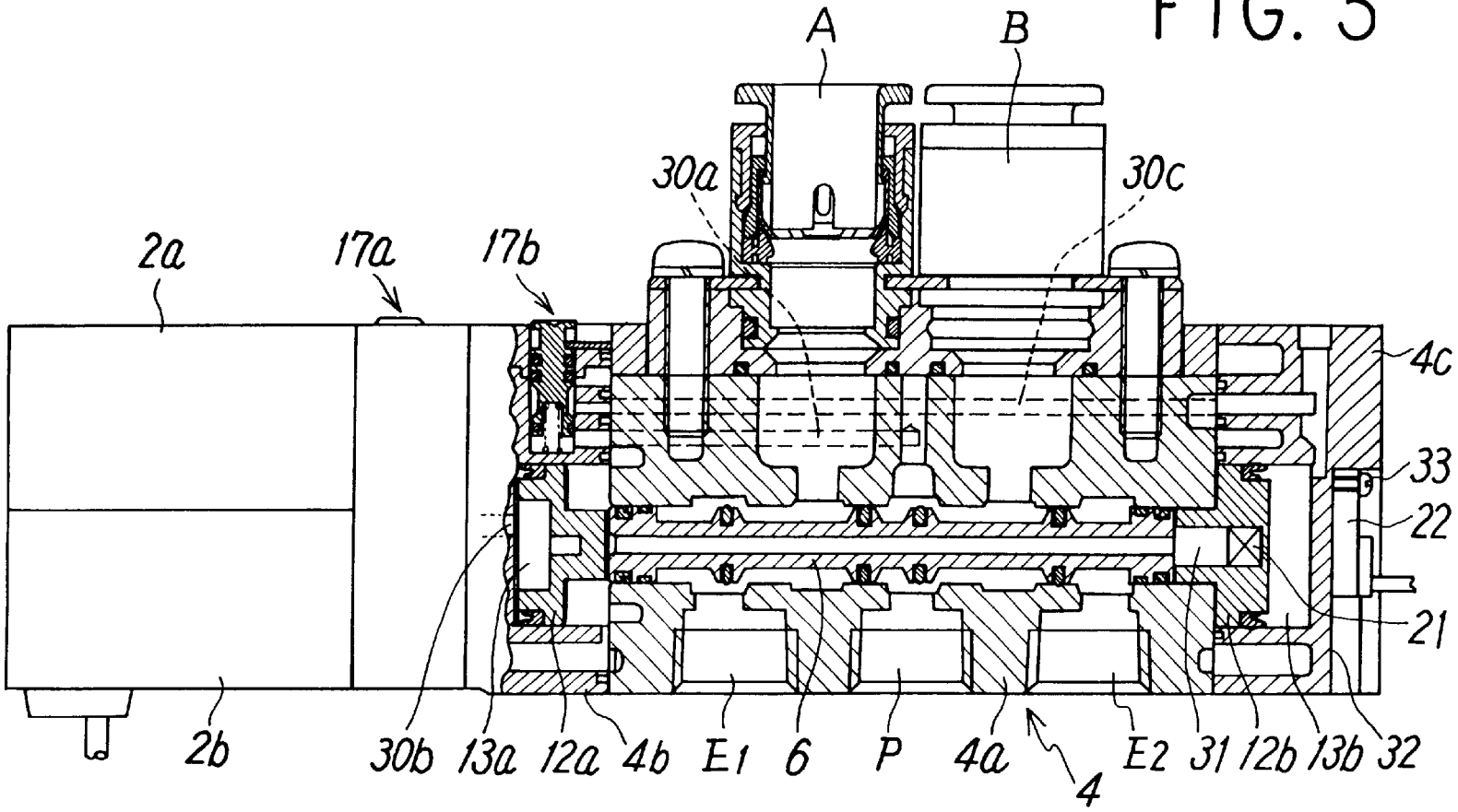
FIG. 3 is a partially sectional fragmentary schematic illustration showing a second embodiment of the directional control valve in accordance with the present invention.

In the above-described embodiment, although the magnet 21 is mounted on the outer periphery of the piston 12*a*, it may be mounted on any other portion of the piston. In FIG. 3, a second embodiment of the present invention which is differs in the method for mounting a magnet from the first embodiment, is representatively shown by a doublepilot type directional control valve having two pilot valves.

The directional control valve of the second embodiment has two pilot valves 2*a* and 2*b*, and two manual operating mechanisms 17*a* and 17*b*. The pilot valves 2*a* and 2*b* are concentratedly mounted on the one end side (adjacent to the first piston 12*a*) of the casing 4. The two valves 12*a* and 12*b* have the same size, and are each abutted against the end faces of the spool 6 without being unitarily coupled to the spool 6. Also, a first pressure chamber 13*a* communicates with the supply port P through the pilot fluid passages 30*a* and 30*b* via the first pilot valve 2*a* and the first manual operating mechanism 17*a*, and a second pressure chamber 13*b* communicates with the supply port P through the pilot fluid passages 30*a* and 30*c* via the second pilot valve 2*b* and the second manual operating mechanism 17*b*.

The above-described directional control valve is constituted so as to alternately supply the first pressure chamber 13*a* and the second pressure chamber 13*b* with a pilot fluid by means of the two pilot valves 2*a* and 2*b*, and thereby to drive the two pistons 12*a* and 12*b* to change over the spool 6.

Figure 4:
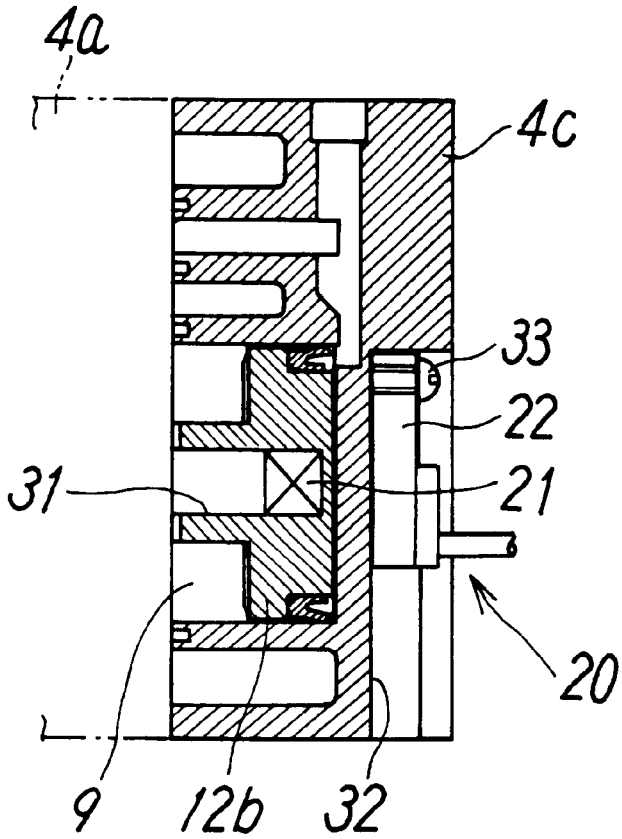
FIG. 4 is an enlarged view showing the main section of FIG. 3.
Figure 5:
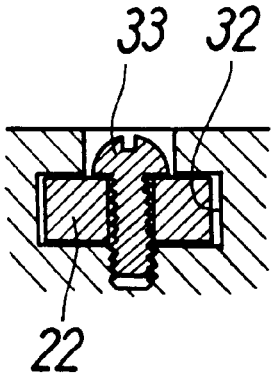
FIG. 5 is an enlarged sectional view showing the main section of FIG. 4.

In this directional control valve, a position detecting mechanism 20 is provided on the side of the second piston 12*b* opposite to the side where the two pilot valves 2*a* and 2*b* are disposed. More specifically, as shown in FIGS. 4 and 5, in the second piston 12*b*, there is formed a housing 31 which extends in the axial direction from the surface abutted against the spool 6 to the pressure receiving surface, and a magnet 21 is installed on the inner bottom portion of the housing 31 so as to be situated adjacent to the pressure receiving surface. On the other hand, in the third member 4*c* of the casing 4, a mounting groove 32 is formed at the back of the wall surface opposite to the pressure receiving surface of the second piston 12*b*, from the lower surface side toward the upper surface side of the second member 4*b*, and a magnetic sensor 22 is inserted into the mounting groove 32, and then fastened with a screw 33.

The above-mentioned magnetic sensor is adapted to detect the change in magnetic flux density when the magnet 21 approaches or moves away from the magnetic sensor 22 with the movement of the second piston 12*b*.

Since constitutions and operations, or preferred modifications of the second embodiment other than the foregoing are substantially the same as those of the first embodiment, description thereof is omitted.

The position detecting mechanism 20 in each of the above-described embodiments does not necessarily require using the above-described method in which all operating positions of the spool 6 are detected from the change in magnetic flux density with the movement of the piston, but the position detecting mechanism 20 may use a method in which only both stroke ends of the spool 6 are detected by turning on/off the magnetic sensor at both stroke ends of the spool 6.

In the above-described first embodiment, as a singlepilot type directional control valve, a directional control valve having large and small pistons 12*a* and 12*b* was shown. Of course, however, the directional control valve may be of the spring-return type which has a return spring in place of the second piston of 12*b* of small diameter, and which always energizes the spool 6 in the return direction by the energizing force of the return spring.

Alternatively, the constitution of the position detecting mechanism 20 in the first embodiment may be applied to the double-pilot type directional control valve having two pilot valves. In this case, the two pilot valves may be concentratedly disposed on one side of the casing, as in the second embodiment, or may be disposed one for each of both sides. Also, the position detecting mechanism 20 may be disposed on the first piston side, or may be disposed on the second piston side.

As has been described hereinbefore in detail, in accordance with the present invention, by installing the magnet for position detecting on the piston, operating positions of the valve member can be detected via the piston. At this time, in addition, by installing the magnet at a position adjacent to the breathing chamber in the piston, it is possible to prevent the magnet from contacting the pilot fluid. Therefore, even if the pilot fluid contains water, chemical mist, magnetic particles such as metallic powder, or the like, there is no risk of the magnet rusting, corroding, or adsorbing magnetic particulates due to the contact of the magnet 21 with these substances. This prevents the reduction in position detecting accuracy due to the decrease in magnetic force, or the occurrence of a malfunction of the piston 12*a* due to adsorbed particulates, which permits the maintaining of a stable performance.

What is claimed is:

1. A pilot operated directional control valve having a position detecting function, comprising:

a plurality of ports;

a valve hole to which each of said ports is opened;

a casing having said ports and said valve hole;

a valve member for changing over flow passages, said valve member being slidably received in the valve hole;

a piston chamber formed on at least one end side of said valve member;

a piston slidably received in said piston chamber, said piston operating by the action of pilot fluid pressure to change over said valve member;

breathing chambers each opened to the outside, said breathing chambers being each defined by said piston and said valve member;

end sealing members for shutting off said breathing chambers from the hydraulic fluid passages in the valve hole, said end sealing members being mounted on the outer peripheries of the end portions of said valve member;

piston packing for shutting off the pilot pressure chamber adjacent to one end of said piston, from said breathing chamber, said piston packing is mounted on the outer periphery of said piston;

a magnet being displaced together with said piston, said magnet being installed at a portion, on one piston, adjacent to the breathing chamber and more interior than said piston packing;

at least one magnetic sensor for detecting the magnetism from said magnet, said at least one magnetic sensor being mounted at a position in the casing, adjacent to the magnet; and at least one pilot valve for supplying said pilot pressure chambers with the pilot fluid.

2. A directional control valve as claimed in claim 1, wherein said magnet is provided on the outer periphery of the piston, and wherein said magnetic sensor is provided at a portion in the casing, adjacent to the outer periphery of said piston chamber.

3. A directional control valve as claimed in claim 1, further comprising:

a housing formed in the surface opposite to the valve member, in said piston, said housing extending in the direction of a pressure receiving surface of said piston;

wherein said magnet is installed in said housing so as to be situated adjacent to said pressure receiving surface, and wherein said magnetic sensor is disposed at a position opposite to said pressure receiving surface, in the casing.

4. A directional control valve as claimed in claim 3, wherein said directional control valve is a double-pilot type directional control valve having two pistons and two pilot valves, wherein said two pilot valves are concentratedly disposed on one end side of the casing, and wherein on the side opposite to the side where said pilot valve is installed, in the casing, said magnet and said magnetic sensor are disposed on said piston and said casing, respectively.

5. A directional control valve as claimed in claim 1, wherein said piston having said magnet and the valve member are unitarily coupled.

6. A directional control valve as claimed in claim 1, wherein said magnetic sensor is disposed so as to be able to detect the magnetism from the magnet over the whole stroke of the piston, and wherein said magnetic sensor is constituted so as to detect all operating positions of the piston from the change in magnetic flux density with the displacement of the magnet.

* * * * *

UNITED STATES PATENT AND TRADEMARK OFFICE

CERTIFICATE OF CORRECTION

PATENT NO. : 6,220,284 B1
DATED : April 24, 2001
INVENTOR(S) : Hayashi et al.

It is certified that error appears in the above-identified patent and that said Letters Patent is hereby corrected as shown below:

Title page,
Item [30], the Foreign Application Priority Data has been omitted, item [30] should read as follows:

-- [30] Foreign Application Priority Data
July 12, 1999 [JP] Japan .....11-197778 --

Signed and Sealed this

Thirtieth Day of October, 2001

*Attest:*

Nicholas P. Godici

NICHOLAS P. GODICI
*Acting Director of the United States Patent and Trademark Office*

*Attesting Officer*